United States Patent [19]

Jung

[11] Patent Number: 4,976,644

[45] Date of Patent: Dec. 11, 1990

[54] MANUFACTURING METHOD FOR DISPENSER CATHODE FOR AN ELECTRON GUN

[75] Inventor: Jong-in Jung, Jungja, Rep. of Korea

[73] Assignee: Samsung Electron Devices Co., Ltd., Rep. of Korea

[21] Appl. No.: 431,246

[22] Filed: Nov. 3, 1989

[30] Foreign Application Priority Data

Nov. 12, 1988 [KR] Rep. of Korea ..... 88-14905

[51] Int. Cl.[5] ..... H01J 9/04

[52] U.S. Cl. ..... 445/50; 445/51; 427/34; 427/78

[58] Field of Search ..... 445/50, 51; 429/34, 429/77, 78

[56] References Cited

U.S. PATENT DOCUMENTS 3,075,066 1/1963 Yenni et al. ..... 445/51 X
3,176,180 3/1965 Affect, III ..... 445/50 X
4,279,709 7/1981 McIntyre ..... 427/34 X
4,331,528 5/1982 Beer et al. ..... 427/34 X

FOREIGN PATENT DOCUMENTS 707285 4/1954 United Kingdom ..... 445/50

*Primary Examiner*—Kenneth J. Ramsey
*Attorney, Agent, or Firm*—Leydig, Voit & Mayer

[57] ABSTRACT

A manufacturing method for a dispenser cathode for the electron gun, said cathode comprising a container, an electron emissive material in the container, a porous metal body covering the emissive material, and a sleeve supporting the container. The method includes gas plasma sputtering process to form a porous metal body over the surface of the electron emissive material in the container. The method also may include forming a skirt along the upper edge of the container to strengthen the adherence of the porous metal body to the skirt and to achieve tight sealing of the skirt and porous metal body. The method also can prevent damage of the porous metal body, and can increase the beam currents.

5 Claims, 1 Drawing Sheet

MANUFACTURING METHOD FOR DISPENSER CATHODE FOR AN ELECTRON GUN

BACKGROUND OF THE INVENTION

The invention relates to a manufacturing method for a dispenser cathode for an electron gun used in ultralarge cathode ray tubes, projection tubes or hi-vision, etc., and, in particular, to a manufacturing method for a porous metal body of the cavity reservoir-type dispenser cathode.

In general, the structure of a cavity reservoir type dispenser cathode is as schematically illustrated in FIG. 1. A cup-type container 1 is mounted on the upper part of a sleeve 4 with a built-in heater 5, an electron emissive material 2 and a porous metal body 3 disposed in the container 1 in a stratiform shape.

The cavity reservoir type dispenser cathode as constructed above, as is well known, is capable of emitting electrons by a forming monoatomic layer from Ba diffused from below and from atoms contained in the porous metal body 3. The Ba diffuses from electron emissive material 2 due to the heat energy from the heater 5 through the pores of the porous metal body 3 and reaches the surface of the porous metal body. Since the ordinary operating temperature of such a dispenser cathode is 1050° C. to 1200° C., heat-resistant materials are required for making the dispenser cathode.

For example, the above-mentioned porous metal body is made of W, Mo, Ir or Os, whilst the container and the sleeve holding this porous metal body is W, Mo or Ta.

A good example of this kind of manufacturing method for cathodes is disclosed in U.S. Pat. No. 4,823,044. This patent describes that each component is manufactured through respective separate processes and then all components are assembled together. In this method, electron emissive material is disposed in the container and a porous metal body is sealingly mounted thereon by welding the porous metal body to the upper edge of the container. The welding is done with a high-powered laser welder, rather than an ordinary spot welder or gas welder.

Such a conventional manufacturing method has several disadvantages as described below, because it requires separate processes for producing the porous metal body and for welding the porous metal body to the container:

(A) The manufacturing process is complicated due to the separation of processes and the laser welder which is expensive.

(B) The porous metal body may be damaged by the heat generated during welding.

(C) Complete sealing between the porous metal body and the container cannot be expected and thus the electron emission ability may fall because the porous metal body is welded to the container at several spots.

Therefore, the object of the present invention is to provide a manufacturing method for a dispenser cathode for an electron gun whose manufacturing is simple and whose current density is improved.

SUMMARY OF THE INVENTION

To accomplish the above object, the manufacturing method for the dispenser cathode of the electron gun according the present invention comprises a process of melting the porous metal powder by means of a plasma discharge in an inert gas and spraying the same over the surface of the electron emissive material stored in the container to form the porous metal body.

BRIEF DESCRIPTION OF THE DRAWING FIGURES

Hereinafter the present invention will be described in more detail with reference to the attached drawings wherein.

DETAILED DESCRIPTION OF PREFERRED EMBODIMENTS

Figure 1:
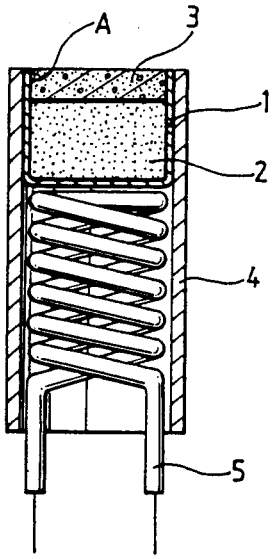
FIG.1(Prior Art)
FIG. 1 is a schematic cross section view of a conventional cathode.
Figure 2:
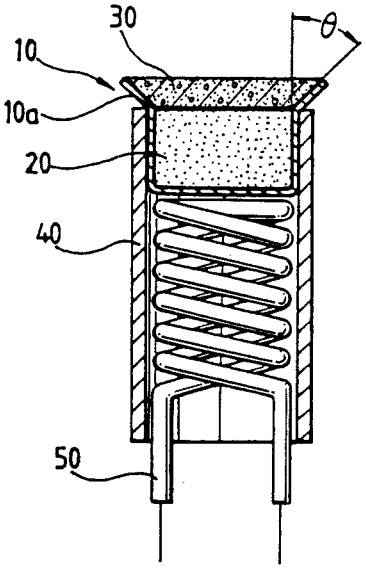
FIG. 2 is a schematic cross section view of the cathode according to the present invention.

As illustrated in FIG. 2, a schematic cross section view of an embodiment of the dispenser cathode according to the present invention, a dish type skirt 10*a* is formed upwardly and outwardly along the upper edge of the container 10 and the container 10 is filled with electron emissive material 20 of BaO, $Al_2O_3$, CaO and W and porous metal body 30 in the order mentioned.

The side surface and the bottom of the porous base body 30 are closely adhered respectively to the inner surface of the skirt 10*a* and the upper surface of the electron emissive material. The container is held and supported by the sleeve 40 within which the heater 50 is stored.

The manufacturing method for the cathode as constructed above is as follows.

First, the electron emissive material 20, made by baking a powder of BaO, $Al_2O_3$, CaO and W, is disposed the container 10 such that the upper surface of the electron emissive material 20 nearly approaches the border between the container and the skirt, reserving space for the porous metal body thereabove. Subsequently, a powder of W, Ta, Ir and Os or the powder of metal alloy thereof is melted in a high temperature of plasma produced in an atmosphere of an inert gas. Then melted metal is sprayed over the upper surface of electron emissive material 20 and inner surface of the skirt 10*a*. The amount of sprayed metal should by controlled to obtain the desired thickness of the porous metal body 30.

In forming the porous metal body 30 in the manufacturing method according to the present invention, the angle of the skirt 10*a* relative to the container determines the thickness of the porous metal body 30 and has an influence upon the adhesive strength thereof. According to experiments by the inventor, acceptable dimensions and adhesive strength of the porous metal body 30 are obtainable within the range of 15° to 90° for the angle Θ between the skirt and container. When Θ is less than 15°, the adhesive strength could not reach the required level. When Θ is about 90°, satisfactory shape and acceptable dimensions of the porous metal body 30 were hardly ever achieved.

Further, the porosity of the porous metal body of the cathode according to the present invention turned out to reach as much as 20% when tungsten powder whose particle diameter is 5 μm was sprayed from the distance of 15–25 cm by means of an arc plasma of Argon with a voltage and current of 45 volts and 500 amperes. The same porosity as the above, i.e., 20% was also realized when tungsten powder was sprayed from the distance of 5–10 cm by arc plasma obtained with a voltage and current of 40 volts and 350 amperes.

As described above, since the manufacturing method for the cathode according to the present invention including forming the porous metal body by a plasma coating method, the process is shortened compared with the conventional method. Further, the porous metal body is adhered over the whole contacting surface of the skirt and electron emissive material so that it is secured very strongly to the skirt and electron emissive material. Further, the tight sealing between the porous metal and the skirt is achieved so that the leakage of diffused Barium emitted from electron emissive material is effectively prevented, with the result that current density is remarkably increased.

What is claimed is;

1. A manufacturing method for a dispenser cathode for an electron gun comprising a container, an electron emissive material disposed in the container, and a porous metal body covering the emissive material including melting a metal power in a plasma discharge in an inert gas and spraying the melted metal powder onto the the electron emissive material to form the porous metal body.

2. The manufacturing method for a dispenser cathode for an electron gun as claimed in claim 1 including mounting a peripheral skirt on the container prior to spraying the melted metal powder for retaining the sprayed metal powder whereby the adherence of the porous metal body is improved and tight sealing of the porous metal body and the skirt is achieved.

3. The manufacturing method for a dispenser cathode for an electron gun as claimed in claim 1, including establishing the angle between the skirt and the container as within 15°–90°.

4. The manufacturing method for a dispenser cathode for an electron gun as claimed in claim 1 including mounting a flared peripheral skirt having a frusto-conical surface projecting from the container on the container adjacent the electron emissive material for retaining the metal powder sprayed on the electron emissive material.

5. The manufacturing method for a dispenser cathode for an electron gun as claimed in claim 4 including mounting the skirt so that the surface forms an internal angle between 15 and 90 degrees with the container.

* * * * *